US006014922A

United States Patent [19]

Livingston

[11] Patent Number: 6,014,922

[45] Date of Patent: Jan. 18, 2000

[54] SHORT RANGE/INTERMEDIATE RANGE LASER DEFENSE AGAINST CHEMICAL AND BIOLOGICAL WEAPONS

[75] Inventor: Peter M. Livingston, Palos Verdes Estates, Calif.

[73] Assignee: TRW Inc., Redondo Beach, Calif.

[21] Appl. No.: 08/989,188

[22] Filed: Dec. 11, 1997

[51] Int. Cl.[7] ..... B64D 1/04; F41G 1/32

[52] U.S. Cl. ..... 89/1.11; 89/41.06

[58] Field of Search ..... 89/41.13, 41.07, 89/41.06, 1.11; 235/404

[56] References Cited

U.S. PATENT DOCUMENTS

| | | | |
|---|---|---|---|
| 3,427,611 | 2/1969 | Enenstein | 235/404 |
| 4,015,508 | 4/1977 | Blodgett, Jr. et al. | 89/41.13 |
| 4,456,912 | 6/1984 | Ensley | 235/404 |
| 4,464,975 | 8/1984 | Terry et al. | 89/41.13 |
| 4,647,759 | 3/1987 | Worsham et al. | 235/404 |
| 4,759,145 | 7/1988 | Volansky | 89/41.13 |
| 4,882,974 | 11/1989 | Reuter et al. | 89/41.13 |
| 5,171,933 | 12/1992 | Eldering | 89/41.06 |
| 5,198,607 | 3/1993 | Livingston et al. | 89/1.11 |
| 5,612,503 | 3/1997 | Sepp | 89/1.11 |
| 5,747,720 | 5/1998 | Schnurr et al. | 89/1.11 |

*Primary Examiner*—Theresa M. Wesson
*Attorney, Agent, or Firm*—Michael S. Yatsko

[57] ABSTRACT

A intermediate range/short range laser defense system (10) for use against chemical and biological submunitions (36). The system includes a source (12) of a high power laser beam (14) which is directed by a beam steering device (16). The beam steering device (16) is controlled by a processor (20) which generates control signals (22) for orienting the beam steering device (16) to the control the laser beam (18). The processor (20) operates in a LACROSST mode which enables detection of the submunitions (36). The processor (20) receives tracking information from a detector (26) and tracker (24). The processor directs the laser beam (18) towards a centroid (40) of a dispersion pattern or cloud (38). The laser beam (18) is then directed in an outward, spiral path (42) from centroid (40). When the laser beam (18) encounters a submunition (36), the laser beam locks onto the submunition (36) in order to heat the submunition (36), thereby denaturing or destroying the submunition (36).

14 Claims, 2 Drawing Sheets

SHORT RANGE/INTERMEDIATE RANGE LASER DEFENSE AGAINST CHEMICAL AND BIOLOGICAL WEAPONS

BACKGROUND OF THE INVENTION

1. Technical Field

This invention relates generally to a defense system against chemical and biological weapons and, more particularly, to a short range/intermediate range, laser defense system for defeating airborne chemical and biological weapons.

2. Discussion

The use of chemical and biological weapons (CB weapons) has been a source of increasing concern to military strategists. Because of their relatively common availability and ease with which they can be used to attack an enemy, the threat from CB weapons has become one for which a defense system must be developed. Of particular concern, these weapons can cause great suffering, pain, and permanent injury to the victims.

Present defense systems against CB weapons and submunitions are almost totally ineffective. Typically, dozens of small objects in the shape of a sphere or oblong ball are dispersed from a carrier missile by a low order explosion at a typical altitude of approximately 1 kilometer. This altitude is chosen to ensure a sufficient coverage of the ground by the chemical. The balls contain the lethal chemical which is released when the balls contact the ground. Alternatively, some CB weapons submunitions deploy small drogues to further aid dispersion and to slow descent of the submunitions. As the submunitions fall to a lower altitude, or sometimes even on the ground, the submunitions explode spreading the lethal contents on the personnel below.

Thus, there is a need to provide a CB weapons defense system which deactivates the lethal, chemical agents carried by the submunitions.

SUMMARY OF THE INVENTION

Accordingly, the present invention provides a method for deactivating a plurality of submunitions released at an altitude to disperse the submunitions. The method includes tracking a carrier vehicle carrying the submunitions to where the carrier vehicle releases the submunitions in a dispersion pattern. After locating an approximate centroid of the dispersion pattern, a laser beam is directed toward the centroid. The method further includes displacing the laser beam in a generally outward spiral from the centroid of the dispersion pattern so that the laser beam detects a submunition encountered during the spiral displacement. The laser beam deactivates the detected submunition. After deactivation, the laser beam is further displaced in a spiral pattern so that the laser beam detects and deactivates additional submunitions of the plurality of munitions.

The invention further provides an apparatus for deactivating munitions released at an altitude by a carrier vehicle in a dispersion pattern. The apparatus includes a laser generator for generating a beam of laser energy. A tracker tracks the carrier vehicle and determines an approximate location where the carrier vehicle released the munitions. A beam steerer steers the beam of laser energy, and a processor controls the beam steerer to direct the laser beam to in proximity to a centroid of the dispersion pattern so that the laser beam moves in a spiral pattern outward from the centroid so that the laser beam deactivates the munitions upon encountering the submunitions.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
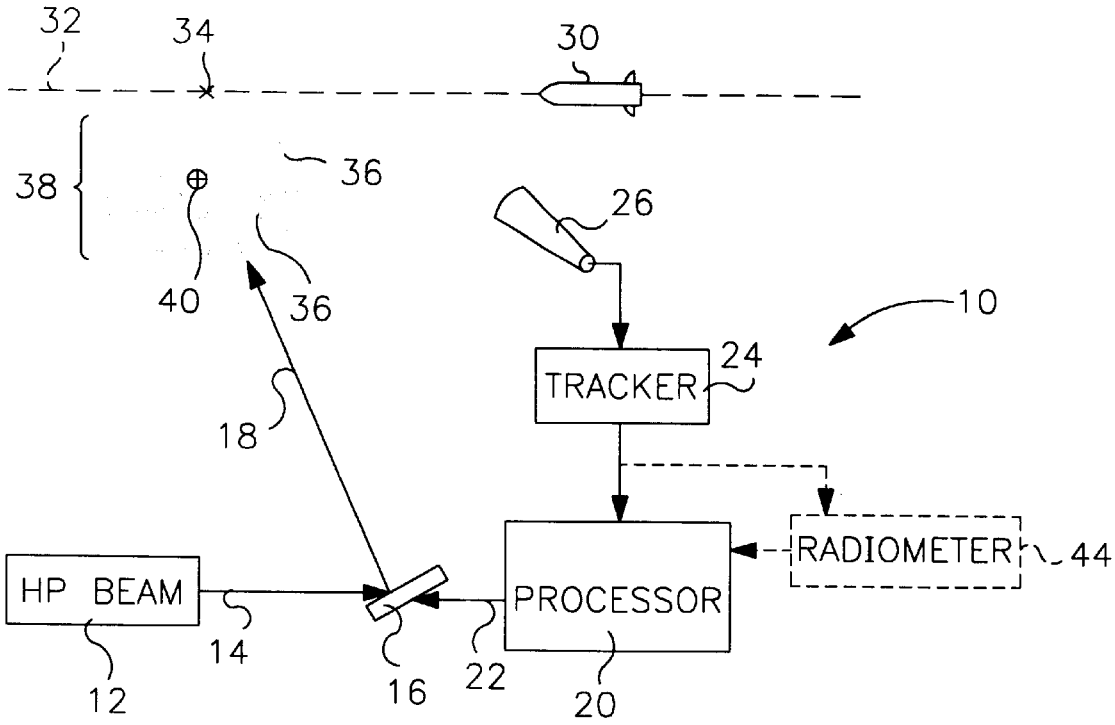
FIG. 1 is a block diagram of the short range/intermediate laser defense against CB weapons system arranged in accordance with the principles of the present invention.

FIG. 1 is a block diagram of the short range/intermediate range laser defense against chemical and biological weapons system (CB) defense system 10. The system includes a high power laser beam source 12 which outputs a laser beam 14 in the direction of laser beam steerer 16. Laser beam steerer 16 is typically a mirror which is gimbaled in order to variably reflect laser beam 14, shown as beam 18 in the direction of the intended target. Processor 20 generates control commands on control line 22 to direct orientation of beam steerer 16 in order to steer laser beam 18 in accordance with the principles of the present invention. Processor 20 receives input from a tracker 24. A telescope or other detector 26 detects a carrier missile 30 and outputs data signals to tracker 24 in order to enable tracker 24 to determine the general position of carrier missile 30. Tracker 24 outputs this information to processor 20 which in turn generates control commands 22 for orienting beam steerer 16 to direct laser beam 18 in the desired direction.

In operation, the detector or telescope 26 tracks the carrier missile 30, which follows a line of flight 32. A low order explosion, as may occur at marker 34 causes carrier missile 32 to disperse CB submunitions 36 in a cloud or dispersion pattern 38 which spreads as the submunitions 36 fall toward the ground. Once dispersion of the CB submunitions 36 occurs, as at marker 34, processor 20 directs laser beam 18 in the general direction of the centroid 40 of the dispersion pattern 38. Laser beam 18 is steered through dispersion pattern 38 in order to deactivate the CB submunitions 36, as will be described further herein.

Laser beam 18 heats submunitions 36 in order to deactivate submunitions 36. Presently, all known biological substances and most known chemical agents are labile and may be denatured by heat. Through use of high power laser beam 18 generated by laser beam source 12, a very short dwell period of laser beam 18 on the casing of a submunition 36 sufficiently heats the submunition 36 to denature or to destroy the contents. A typical dwell time, depending on the range and the weather, is usually less than a second.

Until now, a particular difficulty in applying laser weaponry to destroy the submunitions 36 is that the individual submunitions are smaller than the resolution limit of present image trackers. In accordance with the principles of the present invention, however, the present invention uses a non-imaging system defined as a laser crossbody tracking system (LACROSST) to track and destroy the individual CB submunitions 36. In the operation of the LACROSST system scattered laser power from a targeted CB submunition 36 is used to lock laser beam 18 onto submunition 36 for either a predetermined time to sufficiently heat and denature the submunition 36 or until the individual submunition 36 explodes and burns as determined by the telescope or detector 26 and tracker 24. In operation, processor 20 dithers the beam 18 in small amplitude angle oscillations at two frequencies and in orthogonal directions so that after several dither cycles, processor 20 generates control signals to direct beam steerer 16 to lock laser beam 18 onto an individual submunition 36. A more detailed description of the operation of the LACROSST system can be found with reference to U.S. Pat. No. 5,780,838, issued Jul. 14, 1998. U.S. Patent entitled "Laser Crossbody Tracking System and Method", and U.S. Pat. No. 5,780,839, issued Jul. 14, 1998, entitled "Laser Crossbody and Feature Curvature Tracker", both assigned to the Assignee of the present invention, and incorporated by reference herein.

Figure 2:
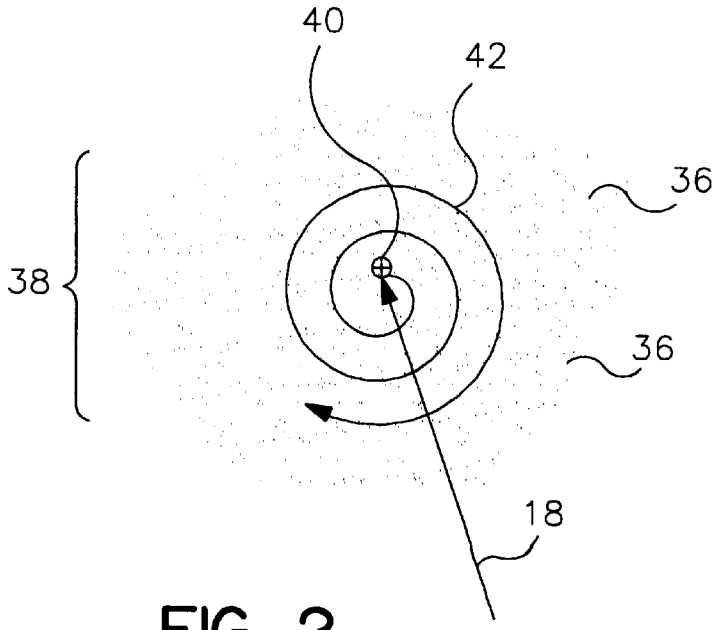
FIG. 2 is a diagram of a typical spiral pattern employed by the system of FIG. 1 to destroy or deactivate the CB submunitions.

Referring to FIG. 2, the pattern in which laser beam 18 is steered by the CB defense system 10 is shown. Laser beam 18 is directed towards centroid 40 of the dispersion pattern or cloud 38 of submunitions 36. From the centroid 40, laser beam 18 is steered in a generally spiral path 42 starting at centroid 40 and progressing generally outwardly. As laser beam 18 detects a submunition 36, the laser beam locks onto the detected submunition 36, thereby denaturing or destroying the submunition. After the laser beam 18 has followed spiral path 42 and no longer detects submunitions 36, processor 20 directs laser beam 18 back toward centroid 40 to trace additional spiral paths 42 to destroy or denature additional CB submunitions 36.

In the present invention, two approaches to destroying or denaturing the CB munitions 36 may be employed. In a first method, the irradiance delivered to targets of like composition, such as inert warhead material having similar thermal properties to submunitions 36, is determined in a laboratory setting. The median lethal dose (MLD) is determined as a dose that neutralizes 50 percent of the sample composition High power laser beam source 12 is then programmed to irradiate the target with a predetermined number of MLDs for each submunition 36, including adjustment for atmospheric and propagation conditions. A second method involves using a radiometer 44 of FIG. 1 to measure the increase in skin temperature of submunition 36. In such instances, radiometer 44 is included in the CB defense system 10 to sample radiation returned from the particular submunition 36 heated by laser beam 18.

Figure 3:
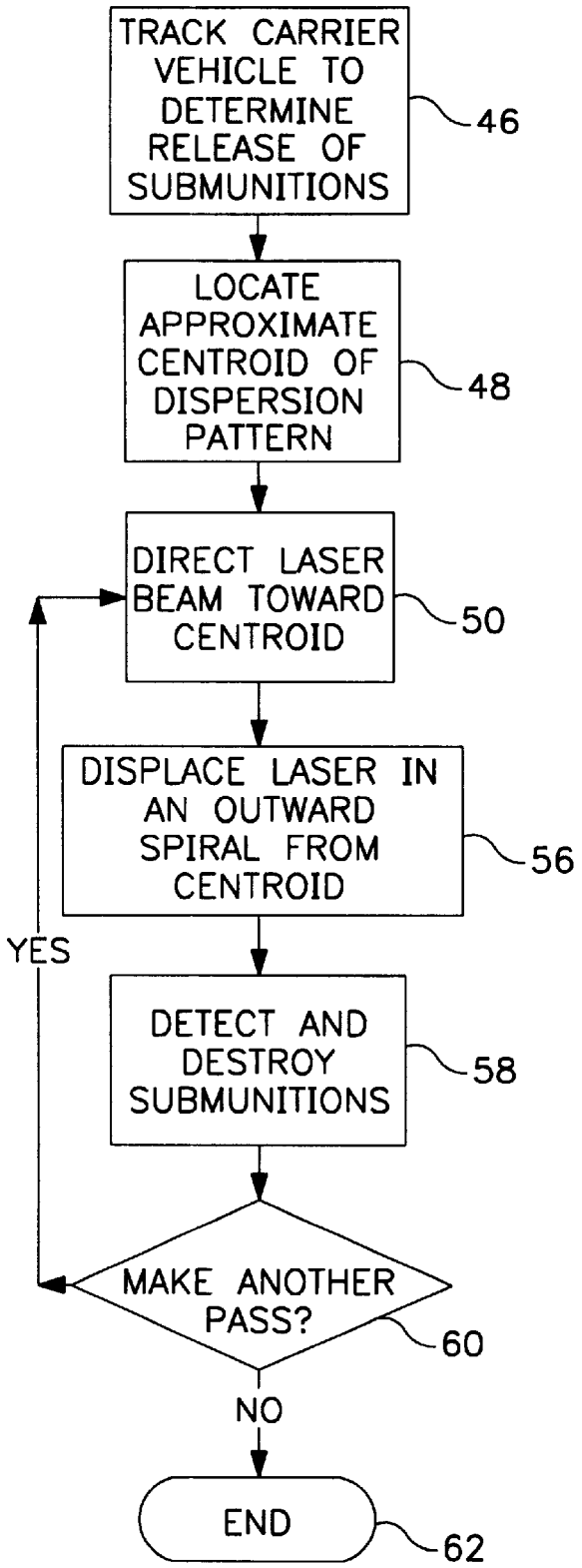
FIG. 3 is a flow chart of the operation of the present invention.

FIG. 3 is a block diagram of the method for carrying out the deactivation or destruction of submunitions 36. At block 46, the carrier vehicle is tracked to detect whether the submunitions have been released. After releasing the submunitions, the tracker locates the approximate centroid of the dispersion pattern as shown at block 48. After the approximate centroid has been located, the laser beam is directed toward the centroid as shown at block 50. At block 56, the laser is displaced in an outward spiral from the centroid in order to detect and destroy munitions as shown at block 58. At block 60, a test is determined if additional passes of the laser should be made through the dispersion pattern. If it is determined that an additional spiral pass should be made, control passes to block 50. If no additional pass is to be made, control passes to block 62.

It can be seen from the foregoing that the invention described herein provides a novel method and apparatus for deactivating or destroying airborne CB weapons. Using the LACROSST method of controlling the laser, the submunitions, which are typically below the resolution of typical imaging, targeting systems, can be targeted and destroyed using the invention described herein.

Various other advantages of the present invention will become apparent to those skilled in the art after having the benefit of studying the foregoing text and drawings, taken in conjunction with the followings claims.

I claim:

1. A method for deactivating a plurality of submunitions released at an altitude to disperse the submunitions, comprising the steps of:

tracking a carrier vehicle of the submunitions to where the carrier vehicle releases the submunitions in a dispersion pattern;

locating an approximate centroid of the dispersion pattern;

directing a laser beam toward the centroid of the dispersion pattern;

displacing the laser beam in a generally outward spiral from the centroid of the dispersion pattern, the laser beam detecting a submunition encountered during the spiral displacement;

deactivating the detected submunition; and continuing to displace the laser beam in the spiral pattern after deactivating the submunition, the laser beam detecting and deactivating additional submunitions of the plurality of munitions.

2. The method of claim 1 further comprising the step of repeatedly displacing the laser in an outward spiral pattern from the centroid of the dispersion pattern to maximize deactivation of the submunitions.

3. The method of claim 1 further comprising the step of deactivating the submunition comprises healing the submunition to deactivate or destroy the submunitions.

4. The method of claim 3 wherein the step of deactivating the submunition further comprises irradiating the submunition at a predetermined energy level.

5. The method of claim 1 further comprising using a LACROSST methodology for detecting and destroying the submunitions.

6. An apparatus for deactivating submunitions released at an altitude by a carrier vehicle in a dispersion pattern comprising:

a laser generator for generating a beam of laser energy;

a tracker to track the carrier vehicle and to determine an approximate location where the carrier vehicle released the submunitions, defined as a centroid of the dispersion pattern;

a beam steerer for steering the beam of laser energy; and a processor to control the beam steerer to direct the laser beam to in proximity to the centroid of the dispersion pattern, the beam steerer then directing the laser beam in a spiral pattern outward from the centroid, wherein the laser beam detects and deactivates the submunitions.

7. The apparatus of claim 6 wherein the processor utilizes a LACROSST mode of detecting the submunitions.

8. A method for deactivating a plurality of submunitions released at an altitude to disperse the submunitions, comprising the steps of:

tracking a carrier vehicle of the submunitions to where the carrier vehicle releases the submunitions in a dispersion pattern;

locating an approximate centroid of the dispersion pattern;

directing a laser beam toward the centroid of the dispersion pattern;

displacing the laser beam in a generally outward spiral from the centroid of the dispersion pattern, the laser beam detecting a submunition encountered during the spiral displacement;

deactivating the detected submunition by heating the submunition, including determining a surface temperature of the submunition to ensure that the surface temperature of the detected submunition achieves a predetermined temperature; and continuing to displace the laser beam in the spiral pattern after deactivating the submunition, the laser beam detecting and deactivating additional submunitions of the plurality of submunitions.

9. The method of claim further comprising the step of repeatedly displacing the laser in an outward spiral pattern from the centroid of the dispersion pattern to maximize deactivation of the submunitions.

10. The method of claim 8 wherein the step of deactivating the submunition further comprises irradiating the submunition at a predetermined energy level.

11. The method of claim 8 further comprising using a LACROSST methodology for detecting and destroying the submunitions.

12. An apparatus for deactivating submunitions released at an altitude by a carrier vehicle in a dispersion pattern comprising:

a laser generator for generating a beam of laser energy;

a tracker to track the carrier vehicle and to determine an approximate location where the carrier vehicle released the submunitions, defined as a centroid of the dispersion pattern;

a beam steerer for steering the beam of laser energy; and a processor to control the beam steerer to direct the laser beam substantially to the centroid of the dispersion pattern, the beam steerer then directing the laser beam in a spiral pattern outward from the centroid, wherein the laser beam detects and deactivates the submunitions, wherein the laser beam reflects from the submunitions and the reflected laser beam is detected by the processor, with the processor utilizing the reflected laser beam to track the submunitions.

13. The apparatus of claim 12 further comprising a radiometer to determine a surface temperature of the submunitions, the surface temperature being input to the processor to determine when the submunitions have been deactivated.

14. The apparatus of claim 12 further comprising a radiometer to determine a surface temperature of the submunitions, the surface temperature being input to the processor to determine when the submunitions have been deactivated.

* * * * *